US010245739B2

(12) United States Patent
Park et al.

(10) Patent No.: US 10,245,739 B2
(45) **Date of Patent: *Apr. 2, 2019**

(54) SHAVER

(71) Applicant: DORCO CO., LTD., Yongin-Si, Gyeonggi-Do (KR)

(72) Inventors: Young Ho Park, Gunpo-Si (KR); Byung Sun An, Ansan-Si (KR)

(73) Assignee: DORCO CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/867,996

(22) Filed: Jan. 11, 2018

(65) Prior Publication Data

US 2018/0194026 A1 Jul. 12, 2018

Related U.S. Application Data

(63) Continuation of application No. 15/416,170, filed on Jan. 26, 2017, now Pat. No. 9,902,077, which is a (Continued)

(30) Foreign Application Priority Data

Jun. 29, 2006 (KR) ..... 10-2006-0059004

(51) Int. Cl.
*B26B 21/22* (2006.01)
*B26B 21/40* (2006.01)
*B26B 21/52* (2006.01)

(52) U.S. Cl.
CPC ..... *B26B 21/225* (2013.01); *B26B 21/4012* (2013.01); *B26B 21/4068* (2013.01); *B26B 21/521* (2013.01)

(58) Field of Classification Search
CPC ..... B26B 21/22; B26B 21/225; B26B 21/521; B26B 21/4012; B26B 21/4068
(Continued)

(56) References Cited

U.S. PATENT DOCUMENTS 3,593,416 A * 7/1971 Edson ..... B26B 21/14 30/50
3,816,912 A * 6/1974 Glaberson ..... B26B 21/24 30/47
(Continued)

FOREIGN PATENT DOCUMENTS

CA 2945100 10/2015
CN 1270548 10/2000
(Continued)

*Primary Examiner* — Jason Daniel Prone
(74) *Attorney, Agent, or Firm* — Lee, Hong, Degerman, Kang & Waimey PC

(57) ABSTRACT

Provided is a shaver including a cartridge and a handle body. The cartridge includes a cartridge body formed in a rectangular frame shape; a plurality of blades installed in the cartridge body in the side-to-side direction of the cartridge body, each of the blades having a front portion bent downward; a pair of side fixation slots formed on left and right frames of the cartridge body, respectively, so as to fix the left and right ends of each blade; a supporter connecting upper and lower frames of the cartridge body; and an inside fixation slot formed on the supporter so as to fix a portion of each blade. The handle body is coupled to the cartridge body.

18 Claims, 5 Drawing Sheets

Related U.S. Application Data continuation of application No. 12/306,626, filed as application No. PCT/KR2007/003110 on Jun. 27, 2007, now Pat. No. 9,604,373.

(58) Field of Classification Search
USPC ..... 30/47–51, 526, 527
See application file for complete search history.

(56) References Cited

U.S. PATENT DOCUMENTS 3,816,913 A * 6/1974 Ferraro ..... B26B 21/24 30/47
4,083,104 A * 4/1978 Nissen ..... B26B 21/50 30/47
4,125,243 A 11/1978 Liptak
4,200,976 A * 5/1980 Gooding ..... B26B 21/222 30/47
4,227,302 A * 10/1980 Torrance ..... B26B 21/225 30/47
4,253,235 A * 3/1981 Jacobson ..... B26B 21/521 30/47
4,257,160 A * 3/1981 Murai ..... B26B 21/4062 30/50
4,266,340 A * 5/1981 Bowman ..... B26B 21/225 30/47
4,270,268 A * 6/1981 Jacobson ..... B26B 21/227 30/47
4,283,850 A * 8/1981 Douglass ..... B26B 21/521 30/47
4,288,920 A * 9/1981 Douglass ..... B26B 21/521 30/47
4,302,876 A * 12/1981 Emmett ..... B26B 21/222 30/47
4,378,633 A * 4/1983 Jacobson ..... B26B 21/227 30/47
4,378,634 A * 4/1983 Jacobson ..... B26B 21/4018 30/47
4,389,773 A * 6/1983 Nissen ..... B26B 21/22 30/50
4,446,619 A * 5/1984 Jacobson ..... B26B 21/521 30/47
4,475,286 A * 10/1984 Saito ..... B26B 21/225 30/50
4,488,357 A * 12/1984 Jacobson ..... B26B 21/225 30/527
4,556,183 A 12/1985 Greenberger
4,621,424 A * 11/1986 Jacobson ..... B26B 21/225 30/50
4,879,811 A * 11/1989 Cooney ..... B26B 21/52 30/527
D306,529 S 3/1990 Goodell
4,932,122 A * 6/1990 Shurland ..... B26B 21/222 30/50
5,010,646 A * 4/1991 Neamtu ..... B26B 21/227 30/50
5,016,352 A * 5/1991 Metcalf ..... B26B 21/225 30/47
5,144,887 A 9/1992 Mietzel
5,157,834 A * 10/1992 Chen ..... B26B 21/225 30/47
5,182,858 A * 2/1993 Chen ..... B26B 21/521 30/49
5,224,267 A * 7/1993 Simms ..... B26B 21/4068 30/50
5,313,706 A * 5/1994 Motta ..... B26B 21/227 30/47
5,347,715 A * 9/1994 Friedland ..... B26B 21/4056 30/526
5,347,717 A * 9/1994 Ts'ai ..... B26B 21/225 30/50
5,416,974 A * 5/1995 Wain ..... B26B 21/227 30/50
5,482,276 A 1/1996 Hall
5,505,421 A 4/1996 Marthaler
5,669,139 A * 9/1997 Oldroyd ..... B26B 21/222 30/47
5,671,534 A * 9/1997 Mayerovitch ..... B26B 21/44 30/50
5,687,485 A 11/1997 Shurtleff et al.
5,761,814 A 6/1998 Anderson et al.
5,822,862 A * 10/1998 Ferraro ..... B26B 21/227 30/50
5,857,654 A 1/1999 Berman
D410,452 S 6/1999 Ancona et al.
5,956,848 A 9/1999 Tseng et al.
5,956,851 A 9/1999 Apprille et al.
6,041,926 A 3/2000 Petricca et al.
6,052,903 A 4/2000 Metcalf et al.
D428,606 S 7/2000 Ancona et al.
6,185,822 B1 2/2001 Tseng et al.
6,212,777 B1 4/2001 Gilder et al.
6,223,442 B1 * 5/2001 Pina ..... B26B 21/225 30/50
6,311,400 B1 * 11/2001 Hawes ..... B26B 21/225 30/50
D453,534 S 2/2002 Kosir
6,397,473 B1 * 6/2002 Clark ..... B26B 21/227 30/50
6,425,184 B1 * 7/2002 Min ..... B26B 21/225 30/51
6,434,839 B1 * 8/2002 Lee ..... B26B 21/225 30/527
6,442,839 B1 9/2002 Tseng et al.
6,516,518 B1 2/2003 Garraway et al.
6,560,881 B2 * 5/2003 Coffin ..... B26B 21/222 30/50
6,612,040 B2 9/2003 Gilder
6,671,961 B1 * 1/2004 Van Eibergen ..... B26B 21/227 30/50
6,678,977 B1 1/2004 Sherman
6,684,513 B1 2/2004 Clipstone et al.
6,804,886 B2 * 10/2004 Wain ..... B26B 21/227 30/50
6,807,739 B2 * 10/2004 Follo ..... B26B 21/44 30/50
6,877,227 B2 * 4/2005 Van Eibergen ..... B26B 21/227 30/50
6,948,249 B2 * 9/2005 Barone ..... B26B 21/222 30/50
7,103,976 B2 * 9/2006 Pennella ..... B26B 21/44 30/526
7,111,401 B2 * 9/2006 Richard ..... B26B 21/222 30/50
7,155,852 B2 1/2007 Vogler
7,200,942 B2 * 4/2007 Richard ..... B26B 21/225 30/526
7,526,869 B2 * 5/2009 Blatter ..... B26B 21/225 30/50
7,574,809 B2 * 8/2009 Follo ..... B26B 21/225 30/50
7,676,929 B2 * 3/2010 Lembke ..... B26B 21/22 30/50
7,730,619 B2 * 6/2010 Ozenick ..... B26B 21/222 30/49
7,877,879 B2 * 2/2011 Nakasuka ..... B26B 21/44 30/50
8,146,255 B2 * 4/2012 Denkert ..... B26B 21/227 30/49
8,166,661 B2 * 5/2012 King ..... A45D 27/225 30/527
8,234,789 B2 * 8/2012 Avens ..... B26B 21/225 30/50
8,359,752 B2 * 1/2013 Bridges ..... B26B 21/222 30/50
8,381,406 B2 * 2/2013 Miyazaki ..... B26B 21/225 30/51
8,561,300 B2 * 10/2013 Rehbein ..... B26B 19/06 30/50

(56) References Cited

U.S. PATENT DOCUMENTS 8,590,162 B2 * 11/2013 Park ..... B26B 21/225 30/50
8,732,955 B2 * 5/2014 Howell ..... B26B 21/521 30/527
8,739,411 B2 * 6/2014 Kinghorn ..... B26B 21/42 30/526
8,793,880 B2 * 8/2014 Taub ..... B26B 21/521 30/50
8,938,885 B2 * 1/2015 Stevens ..... B26B 21/52 30/50
9,469,038 B2 * 10/2016 Iaccarino ..... B26B 21/521
9,604,373 B2 * 3/2017 Park ..... B26B 21/225
9,616,584 B2 * 4/2017 Coresh ..... B26B 21/521
9,694,503 B2 * 7/2017 Papadopoulos-Papageorgis ..... B26B 21/222
9,701,034 B2 * 7/2017 Papadopoulos-Papageorgis ..... B26B 21/222
9,707,688 B2 * 7/2017 Giannopoulos ..... B26B 21/222
9,718,201 B2 * 8/2017 Swenson ..... B26B 21/225
9,731,426 B2 * 8/2017 Kim ..... B26B 21/225
9,757,870 B2 * 9/2017 Giannopoulos ..... B26B 21/222
9,902,077 B2 * 2/2018 Park ..... B26B 21/225
10,022,882 B2 * 7/2018 Griffin ..... B26B 21/225
10,052,776 B2 * 8/2018 Provost ..... B26B 21/225
2002/0104223 A1 * 8/2002 Oldroyd ..... B26B 21/225 30/527
2002/0116831 A1 * 8/2002 Coffin ..... B26B 21/225 30/526
2002/0144404 A1 * 10/2002 Gilder ..... B26B 21/22 30/50
2003/0213130 A1 * 11/2003 Motta ..... B26B 21/225 30/50
2004/0181953 A1 * 9/2004 Follo ..... B26B 21/225 30/527
2004/0181954 A1 * 9/2004 Follo ..... B26B 21/222 30/527
2005/0039338 A1 * 2/2005 King ..... B26B 21/225 30/50
2005/0102847 A1 * 5/2005 King ..... B26B 21/225 30/527
2005/0193572 A1 * 9/2005 Gilder ..... B26B 21/225 30/527
2006/0080839 A1 * 4/2006 Hesketh ..... B26B 21/222 30/50
2006/0218804 A1 * 10/2006 Noble ..... B26B 21/38 30/526
2008/0250647 A1 * 10/2008 Fischer ..... B26B 21/222 30/50
2009/0293281 A1 * 12/2009 Bruno ..... B26B 21/222 30/50
2010/0077617 A1 * 4/2010 Peterson ..... B26B 21/4012 30/50
2010/0251555 A1 10/2010 Park et al.
2011/0232101 A1 * 9/2011 Park ..... B26B 21/227 30/50
2011/0247217 A1 * 10/2011 Johnson ..... B26B 21/225 30/50
2012/0210586 A1 * 8/2012 Lelieveld ..... B26B 19/04 30/527
2014/0331500 A1 * 11/2014 Ren ..... B26B 21/34 30/48
2014/0352154 A1 * 12/2014 Ortins ..... B26B 21/4093 30/50
2015/0306777 A1 * 10/2015 Georgakis ..... B26B 21/222 30/51
2016/0107324 A1 * 4/2016 Robertson ..... B26B 21/521 30/51
2016/0144519 A1 * 5/2016 Hahn ..... B26B 21/227 30/50
2016/0167242 A1 * 6/2016 Noh ..... B26B 21/222 30/50
2017/0136639 A1 * 5/2017 Park ..... B26B 21/14

FOREIGN PATENT DOCUMENTS

| | | |
|---|---|---|
| EP | 1531030 | 5/2005 |
| WO | 9629183 | 9/1996 |
| WO | 2008002069 | 1/2008 |
| WO | 2010093133 | 8/2010 |
| WO | 2016010825 | 1/2016 |
| WO | 2016087007 | 6/2016 |
| WO | 2016203326 | 12/2016 |

* cited by examiner

[Fig. 1]
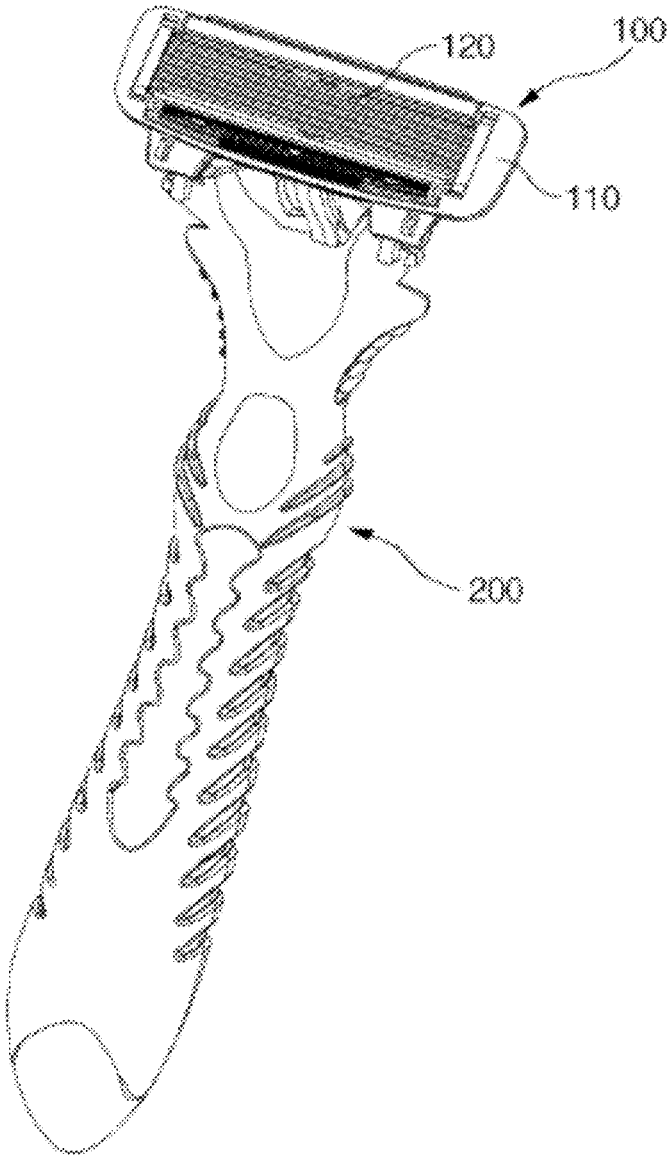

[Fig. 2]
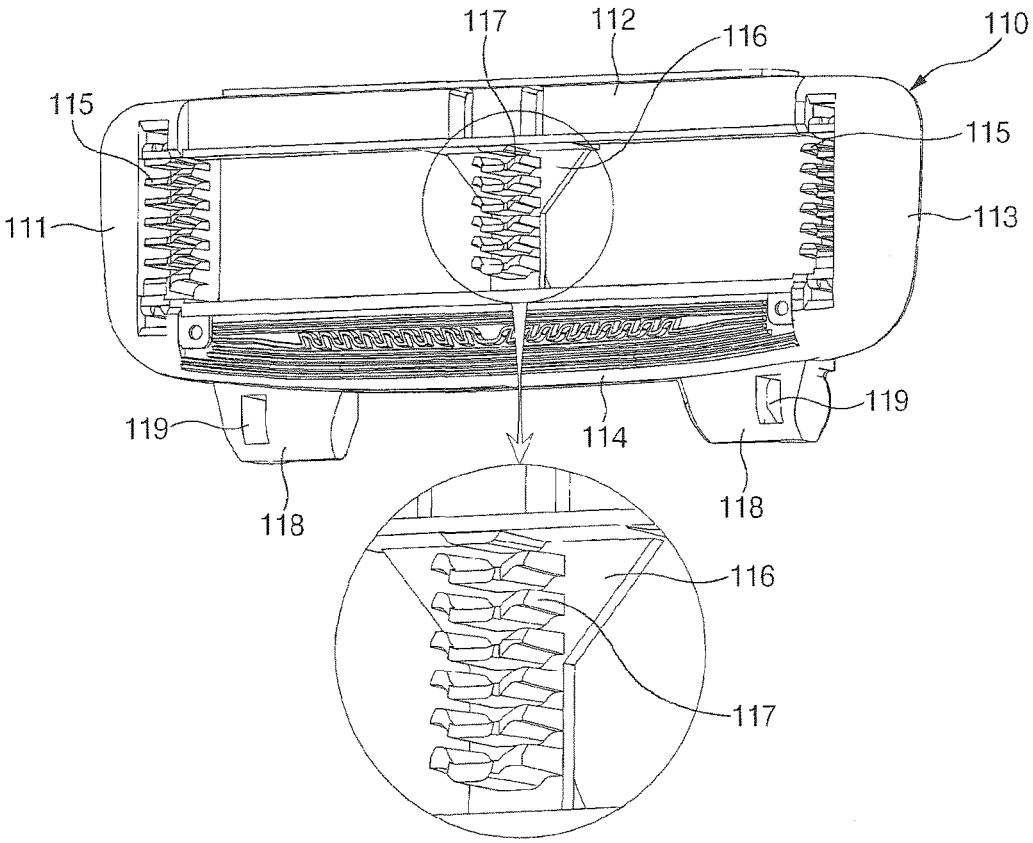
[Fig. 3]
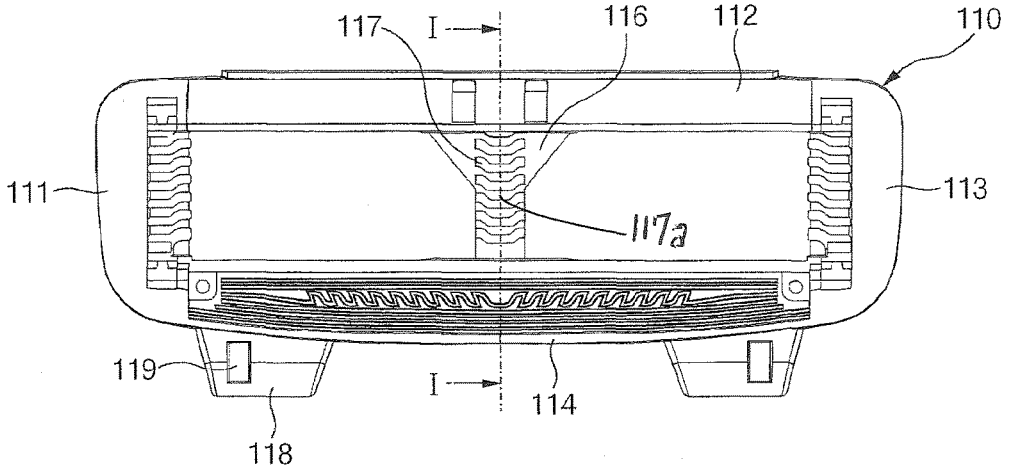

[Fig. 4]
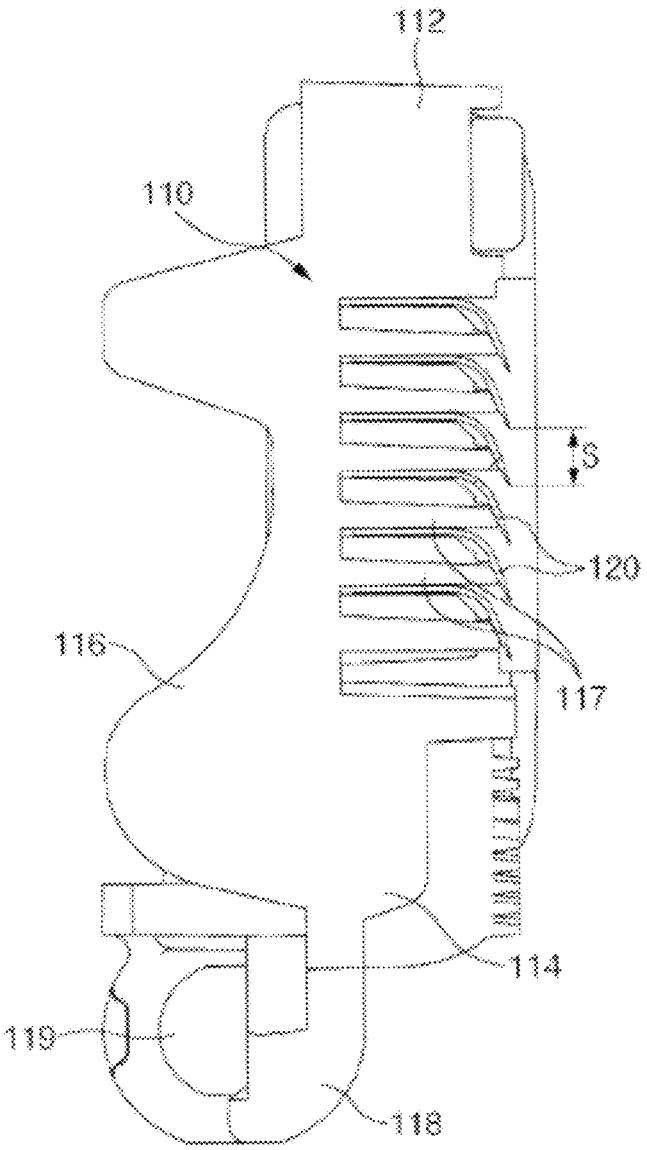
[Fig. 5]
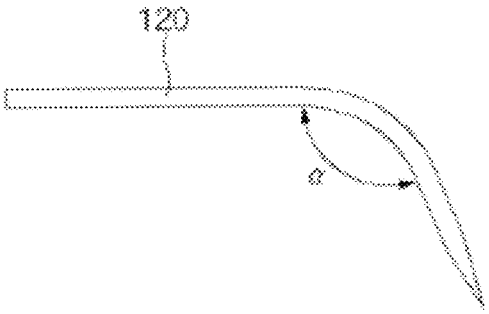

[Fig. 6]
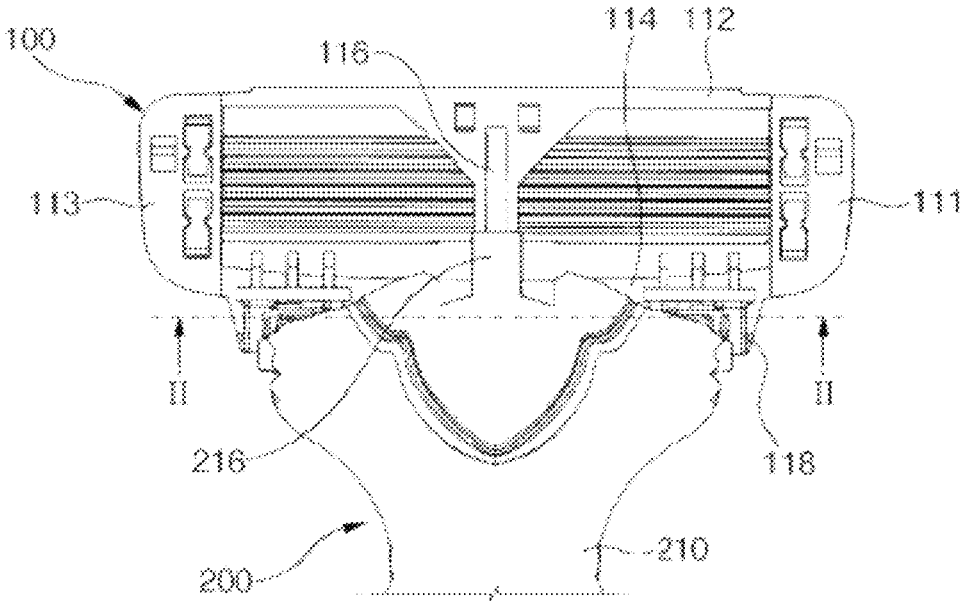
[Fig. 7]
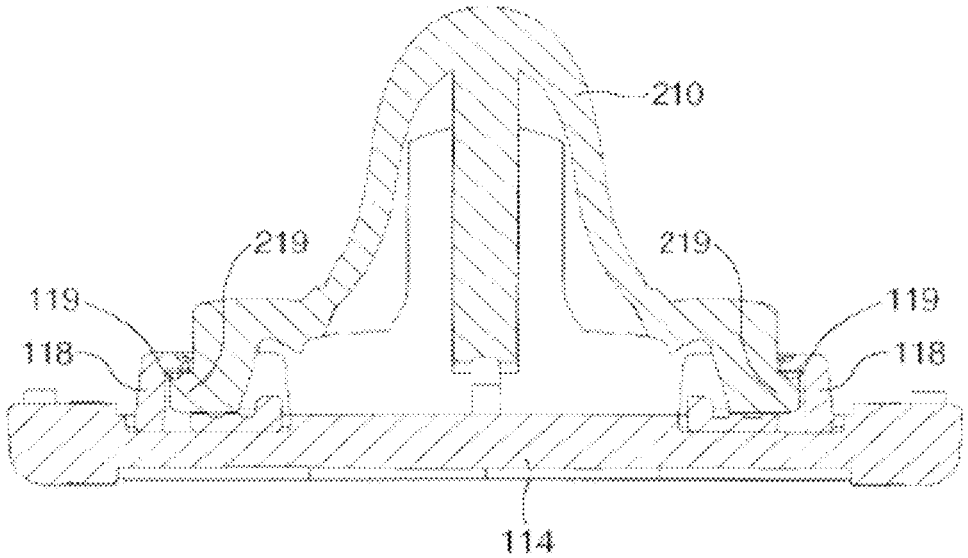

[Fig. 8]
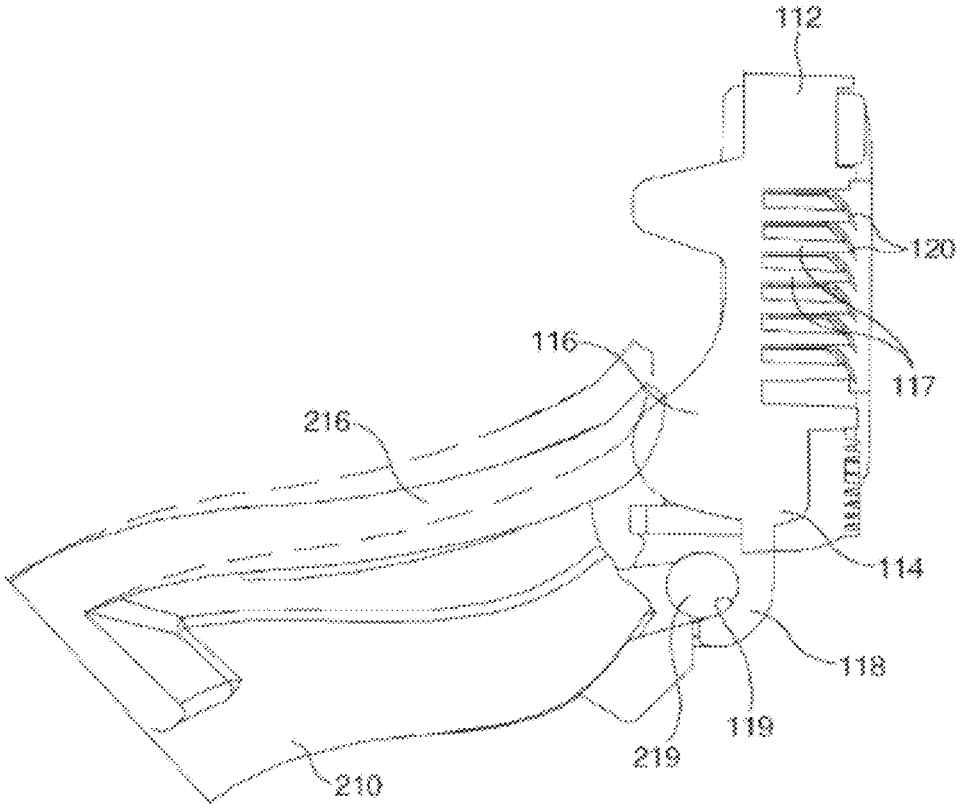

SHAVER

CROSS-REFERENCE TO RELATED APPLICATIONS

This application is a continuation application of U.S. application Ser. No. 15/416,170 filed Jan. 26, 2017 and issued as U.S. Pat. No. 9,902,077 on Feb. 27, 2018, which is a continuation application of U.S. application Ser. No. 12/306,626 filed Dec. 24, 2008 and issued as U.S. Pat. No. 9,604,373 on Mar. 28, 2017, which claims priority to and the benefit of International Patent Application No. PCT/KR2007/003110 filed on Jun. 27, 2007, which claims priority to Korean Patent Application No. 10-2006-0059004 filed on Jun. 29, 2006, all of which are incorporated by reference herein in their entirety.

TECHNICAL FIELD

The present invention relates to a shaver, and more specifically, to a shaver of which the washability, the shaving performance, the stability, and the operating performance can be enhanced.

BACKGROUND ART

In general, a conventional shaver includes a cartridge, on which a plurality of blades for cutting hair such as beard are mounted, and a handle assembly which is held by a user's hand during shaving.

In a state where the cartridge and the handle assembly are coupled to each other, the user holds the handle assembly by hand and closely contacts the cartridge onto the user's skin. Then, the user shaves beard through the blades.

In order to enhance shaving efficiency, the plurality of blades are mounted on the cartridge at a variable distance from each other.

However, when the conventional shaver is used for a long time, sludge composed of beard and other foreign substance is clogged between the blades so as not to be discharged. Therefore, the shaving performance of the shaver is degraded, and the sludge is difficult to wash away.

Further, as the sludge is clogged, various bacterium proliferate, which are harmful to body.

In addition, the conventional shaver has such a structure that both ends of each blade are fixed to the cartridge. Therefore, since a force for fixing the blade is weak, the stability of the shaver decreases.

Furthermore, the cartridge and the handle assembly of the shaver are coupled to each other through a hinge method. In this structure, the swing operation of the cartridge is simply supported by a hinge. Therefore, the surface contact force of the cartridge is so weak that the shaving performance and the operating performance of the shaver are degraded.

DISCLOSURE OF INVENTION

Technical Problem

The present invention provides a shaver which smoothly discharges sludge generated during shaving such that the washability thereof is enhanced. In the shaver, a force for fixing blades is enhanced so as to improve the shaving performance thereof, and a swing operation of a cartridge is elastically supported so as to enhance the stability and the operating performance thereof.

Technical Solution

According to an aspect of the invention, a shaver comprises a cartridge and a handle body. The cartridge includes a cartridge body formed in a rectangular frame shape; a plurality of blades installed in the cartridge body in the side-to-side direction of the cartridge body, each of the blades having a front portion bent downward; pair of side fixation slots formed on left and right frames of the cartridge body, respectively, so as to fix the left and right ends of each blade; a supporter connecting upper and lower frames of the cartridge body; and an inside fixation slot formed on the supporter so as to fix a portion of each blade. The handle body is coupled to the cartridge body.

The inside fixation slot may be formed in a wave shape along the side-to-side direction of the cartridge body.

The plurality of blades may be installed at a variable distance from each other along the top-to-bottom direction of the cartridge body, and the side fixation slots and the inside fixation slot may be formed to correspond to the number of the installed blades and the distance between the installed blades.

The cartridge body and the handle body may be coupled to each other through front hinge mounting.

The cartridge body may have a hinge portion formed on either end of the lower frame thereof, the hinge portion having a hinge groove, and the handle body may have a hinge protrusion formed on either upper end thereof, the hinge protrusion being coupled to the hinge groove.

The handle body may have an elastic portion projecting from an upper portion thereof, the elastic portion being closely contacted with the rear surface of the supporter when the handle body is coupled to the cartridge body, and a swing operation of the cartridge body may be elastically performed by the elastic force of the elastic portion.

The rear surface of the supporter may be convexly curved.

Advantageous Effects

The effects of the shaver according to the invention will be described.

Firstly, since the front portions of the blades are bent downwardly and the cartridge body is formed in a rectangular frame shape, sludge generated during shaving is smoothly discharged to the outside. Therefore, it is possible to improve washability.

Secondly, a portion of each blade is fixed by the inside fixation slot such that the force for fixing the blade is enhanced. Therefore, it is possible to improve the stability and shaving performance of the shaver.

Thirdly, since the swing operation of the cartridge is elastically supported, the contact force of the blade with respect to the skin during shaving is enhanced. Therefore, it is possible to improve the shaving performance and operating performance of the shaver.

BRIEF DESCRIPTION OF THE DRAWINGS

FIG. 1 is a perspective view of a shaver according to the present invention.

FIG. 2 is a perspective view of a cartridge of the shaver according to the invention.

FIG. 3 is a front view of the cartridge of the shaver according to the invention.

FIG. 4 is a cross-sectional view taken along line I-I of FIG. 3.

FIG. 5 is a side view of blades of the shaver according to the invention.

FIG. 6 is a rear view of the shaver according to the invention, showing a state where a cartridge and a handle assembly are coupled to each other.

FIG. 7 is a cross-sectional view taken along line II-II of FIG. 6.

FIG. 8 is a side view illustrating an operating structure of the shaver according to the invention.

BEST MODE FOR CARRYING OUT THE INVENTION

Hereinafter, a shaver according to an embodiment of the invention will be described with reference to FIGS. 1 to 8.

As shown in FIG. 1, the shaver according to the invention includes a cartridge 100 having a plurality of blades 120 mounted thereon and a handle assembly 200 coupled to the cartridge 100.

As shown in FIG. 2, the cartridge 100 includes a cartridge body 110 formed in a rectangular frame shape, the plurality of blades 120 (refer to FIG. 1) installed in the cartridge body 110 in the horizontal direction, plural pairs of side fixation slots 115 are formed on opposing side frame portions 111 and 113 of the cartridge body 110 so as to fix a plurality of blades 120 therein, a supporter 116 for connecting opposing upper and lower frame portions 112 and 114 of the cartridge body 110, a plurality of inside fixation slots 117 each formed on the support 116 so as to fix a portion of each blade 120, and a pair of hinge portions 118 each having a hinge groove 119 for coupling to the handle assembly 200 through front hinge mounting.

As shown in FIG. 3, each inside fixation slot 117 has a waved groove shape in the horizontal direction of the cartridge body 110, the waved groove shape defining an inside convex portion 117*a*.

In the embodiment shown, the inside fixation slot 117 has a side-to-side width and shape so as to reliably fix the blade 120 therein. Preferably, the inside fixation slot 117 has such a width that sludge or waste materials, such as beard cut by the blades 120 and other foreign substance, can be smoothly discharged there-through. For example, the inside fixation slot 117 may be formed to have a side-to-side width of about 2.5 mm.

Each of the side fixing slots 115 is formed in a shape corresponding to the inside fixation slot 117. In this embodiment, since the side fixation slots 115 are formed in the left and right frame portions 111 and 113 of the cartridge body 110, respectively, it is preferable that the width of the side fixation slots 115 is set to be smaller than that of the inside fixation slot 117.

According to the present invention, one inside fixation slot 117 can be provided at a substantially central position between two side fixation slots 115 to fix and support one blade. However, a plurality of inside fixation slots 117 may be provided between the corresponding side fixation slots 115 so as to fix a plurality of blades 120 reliably. It is also contemplated that a plurality of supporters 116 can be provided to have the plurality of inside fixation slots 117 thereon.

Further, the inside fixation slot 117 should be spaced to a proper distance from the two corresponding side fixation slots 115, in order to support the blades 120 more securely with the inside fixation slot 117.

As the thickness of the blade 120 decreases, the distance between the inside fixation slot 117 and the side fixation slots 115 should preferably be reduced. For example, when the thickness of the blade 120 is set in the range of 0.075 to 0.15 mm, the distance between the inside fixation slot 117 and the side fixation slot 115 is preferably set to about 15 mm.

Accordingly, the left and right ends of each blade 120 are fixed and supported by the side fixation slots 115, and a central or inner side portion of the blade 120 is fixed and supported by the inside fixation slot 117. Therefore, a force for supporting the blade 120 is increased, thereby improving the stability and shaving performance during shaving.

As shown in FIG. 4, the plurality of blades 120 are installed to have a predetermined displacement distance from one another along the top-to-bottom direction of the cartridge body 110. That is, the plurality of blades 120 may be installed at same interval or different intervals from each other along the top-to-bottom direction of the cartridge body 110.

As such, the inside fixation slots 117 can be located to have a specific interval selected depending on the number of installed blades 120. Likewise, the side fixation slots 115 can also be located to have such an interval selected depending on the number of installed blades 120.

That is, when the plurality of blades 120 are installed in the cartridge body 110, a predetermined number of blades 120 can be installed at an optimum interval from each other in the side fixation slots 115 and the inside fixation slots 117.

Meanwhile, as shown in FIGS. 4 and 5, the front portion of each blade 120 is bent downwardly from the rear portion thereof.

The blades 120 can be manufactured in the order of punching, heat-treatment, grinding, coating, and bending.

The blades 120 are made to have a proper length and thickness. For example, the overall length of the blade 120 may be set in the range of 3.0 to 4.0 mm, and the thickness thereof may be set in the range of 0.075 to 0.15 mm.

The front portion of each blade 120 is bent downwardly with a proper length and at a proper angle. Preferably, the length of the bent portion of the blade 120 ranges from 0.6 to 1.0 mm, and the front portion forms an angle $\alpha$ with the rear portion, which ranges from 108 to 115 degrees.

In order to accomplish smoother shaving with the plurality of blades 120, the front portions of the blades 120 are integrally bent downwardly from the rear portions thereof such that the distance (i.e., interval) S between the adjacent blades 120 can be set to have an optimally selected value.

That is, as the front portions of the blades 120 are bent from the rear portions thereof, sludge generated during shaving flows along continuous surfaces of the blades 120. Therefore, even though when the distance S between the blades 120 is set to a relatively small value, the sludge can be easily discharged, while a large amount of beard is easily cut. For example, the distance S between the blades 120 can be freely set in the range of 0.7 to 1.5 mm.

As the front portions of the blades 120 are bent downwardly, the distance between the front portions of the blades 120 is smaller than the distance between the rear portions thereof.

Therefore, sludge composed of beard cut by the blades 120 and other foreign substance can more easily flow from the front portions to the rear portions of the blades 120. Therefore, the washability of the shaver can be further enhanced.

In the shaver according to the invention, a predetermined number of blades 120 are installed at optimum interval in the cartridge body 110 such that a force for cutting beard during shaving can suitably be distributed onto the respective blades 120, thereby enhancing the cutting ability and lifespan of the blades 120.

Meanwhile, each of the inside fixation slots 117 may have an inclined surface formed on the front portion thereof such that the front portion of each blade 120 is suitably supported in accordance with the bending angle of the blade 120. For this, the inclined surface of each inside fixation slot 117 is closely contacted with one surface of the front portion of the blade 120.

Preferably, the rear portion of each blade 120 is contacted as closely as possible to the rear portion of each inside fixation slot 117 such that each blade 120 is reliably supported.

Therefore, each inside fixation slot 117 reliably supports the rear portion and the downwardly-bent front portion of each blade 120 such that the blade 120 is securely supported by the slot. Accordingly, it is possible to enhance the stability and operability of the shaver.

FIG. 6 illustrates a state in which 6, the handle body 210 of the handle assembly 200 is coupled to the cartridge body 110.

As shown in FIGS. 6 and 7, the handle body 210 has a pair of hinge protrusions 219 in both upper ends thereof. The hinge protrusions 219 are coupled to the hinge grooves 119 formed in the hinge portions 118 of the cartridge body 110 such that the handle body 210 is assembled into the cartridge body 110 through the front hinge mounting.

In the shaver according to the invention, the hinge portions 118 having the hinge grooves 119 are provided in both ends of the lower frame 114 of the cartridge body 110, and the hinge protrusions 219 coupled to the hinge grooves 119 are provided in both upper ends of the handle body 210. Therefore, the swing center of the cartridge 100 is provided in the lower end of the cartridge 100 such that the swing range of the cartridge 100 increases. Accordingly, shaving can be easily performed on a curved skin.

As shown in FIG. 6, the handle body 210 has an elastic portion 216 projecting from an upper portion thereof. The elastic portion 216 is closely contacted with the rear surface of the supporter 116 as the handle body 210 is coupled to the cartridge body 110.

That is, a swing operation of the cartridge body 110 is elastically supported by the elastic force of the elastic portion 216. Therefore, the contact force of the cartridge 100 with respect to the skin can be optimized, thereby improving the shaving performance of the shaver.

As shown in FIG. 8, it is preferable that the rear surface of the supporter 116 includes a convexly curved surface for this.

That is, due to the convex rear surface of the supporter 116 a further optimized compression force can be applied to the cartridge body 110 by the elastic portion 216 of the handle body 210, when the cartridge 100 is swung. In addition, a restoring force of the elastic portion 216 with respect to the convex compression surface is also optimized, so that the contact force of the cartridge 100 to the skin can be further optimized.

In addition, as the rear surface of the supporter 116 is convexly curved, a frictional force between the elastic portion 216 and the rear contact surface of the supporter 116 is minimized. Then, the swing operation of the cartridge 100 can be more smoothly performed, so that the operating performance of the shaver can be enhanced.

INDUSTRIAL APPLICABILITY

According to the shaver of the invention, sludge generated during shaving is smoothly discharged so that the washability of the shaver can be enhanced. The blades are reliably fixed so as to improve the shaving performance. Further, the swing operation of the cartridge is elastically supported, so that the stability and operating performance of the shaver can be enhanced.

The invention claimed is:

1. A shaver comprising:

a cartridge including:

a cartridge body;

a plurality of blades installed in the cartridge body along an elongated direction of the cartridge body, wherein a rear portion of each of the blades is generally straight;

a plurality of pairs of side fixation slots, each pair of the side fixation slots formed on left and right frame portions of the cartridge body, respectively, so as to fix left and right lateral ends of each corresponding blade;

a supporter provided at a center area between the left and right frame portions of the cartridge body and connecting upper and lower frame portions of the cartridge body, wherein the supporter has a rear surface;

a plurality of inside fixation slots, each formed on the supporter provided at the center area so as to fix the rear portion of each corresponding blade; and a hinge portion formed on either end of the lower frame portion of the cartridge body, the hinge portion having a hinge groove; and a handle body coupled to the cartridge body, the handle body including:

a hinge protrusion being coupled to the hinge groove; and an elastic portion projecting from an upper portion of the handle body, the elastic portion contacted with the rear surface of the supporter so that a swing operation of the cartridge body via the hinge protrusion being coupled to the hinge groove is elastically performed by an elastic force of the elastic portion, wherein the hinge protrusion extends outwardly in a lateral direction.

2. The shaver according to claim 1, wherein each of the blades has a bent front portion.

3. The shaver according to claim 2, wherein a distance between the bent front portions of the blades is set to be smaller than a distance between the rear portions of the blades.

4. The shaver according to claim 2, wherein each of the inside fixation slots has an inclined surface configured to support the bent front portion of each corresponding blade.

5. A shaver comprising:

a cartridge including:

a cartridge body;

a plurality of blades installed in the cartridge body along an elongated direction of the cartridge body wherein a rear portion of each of the blades is generally straight;

a plurality of pairs of side fixation slots, each pair of the side fixation slots formed on left and right frame portions of the cartridge body, respectively, so as to fix left and right lateral ends of each corresponding blade;

a supporter provided at a center area between the left and right frame portions of the cartridge body and connecting upper and lower frame portions of the cartridge body, wherein a rear surface of the supporter is convexly curved;

a plurality of inside fixation slots, each formed on the supporter provided at the center area so as to fix the rear portion of each corresponding blade; and a hinge portion formed on either end of the lower frame portion of the cartridge body, the hinge portion having a hinge groove; and a handle body coupled to the cartridge body, the handle body including a hinge protrusion being coupled to the hinge groove and an elastic portion projecting from an upper portion of the handle body, the elastic portion contacted with the rear surface of the supporter so that a swing operation of the cartridge body via the hinge protrusion being coupled to the hinge groove is elastically performed by an elastic force of the elastic portion.

6. The shaver according to claim 5, wherein each of the blades has a bent front portion.

7. The shaver according to claim 6, wherein a distance between the bent front portions of the blades is set to be smaller than a distance between the rear portions of the blades.

8. The shaver according to claim 6, wherein each of the inside fixation slots has an inclined surface configured to support the bent front portion of each corresponding blade.

9. A shaver comprising:

a cartridge including:

a cartridge body;

a plurality of blades installed in the cartridge body along an elongated direction of the cartridge body;

a plurality of pairs of side fixation slots, each pair of the side fixation slots formed on left and right frame portions of the cartridge body, respectively, so as to fix left and right lateral ends of each corresponding blade;

a supporter provided at a center area between the left and right frame portions of the cartridge body and connecting upper and lower frame portions of the cartridge body, wherein the supporter has a rear surface;

a plurality of inside fixation slots, each formed on the supporter provided at the center area so as to fix a rear portion of each corresponding blade; and a hinge portion formed on either end of the lower frame portion of the cartridge body, the hinge portion having a hinge groove; and a handle body coupled to the cartridge body, the handle body including a hinge protrusion being coupled to the hinge groove and an elastic portion projecting from an upper portion of the handle body, the elastic portion contacted with the rear surface of the supporter so that a swing operation of the cartridge body via the hinge protrusion being coupled to the hinge groove is elastically performed by an elastic force of the elastic portion.

10. The shaver according to claim 9, wherein each of the blades has a bent front portion.

11. The shaver according to claim 10, wherein a distance between the bent front portions of the blades is set to be smaller than a distance between the rear portions of the blades.

12. The shaver according to claim 10, wherein each of the inside fixation slots has an inclined surface configured to support the bent front portion of each corresponding blade.

13. A shaver comprising:

a cartridge body;

a plurality of blades installed in the cartridge body along an elongated direction of the cartridge body, wherein each of the blades has a bent front portion;

a plurality of pairs of side fixation slots, each pair of side fixation slots formed on left and right frame portions of the cartridge body, respectively, so as to fix left and right lateral ends of each corresponding blade;

a supporter provided at a center area between the left and right frame portions of the cartridge body and connecting upper and lower frame portions of the cartridge body;

a plurality of inside fixation slots each formed on the supporter provided at the center area so as to fix a rear portion of each corresponding blade; and a handle body coupled to the cartridge body, wherein a distance between the bent front portions of the blades is set to be smaller than a distance between the rear portions of the blades.

14. The shaver according to claim 13, wherein the rear portion of each blade is generally straight.

15. The shaver according to claim 14, wherein the bent front portion and the rear portion of each blade are integrally formed such that each blade is a unitary blade.

16. A shaver comprising:

a cartridge body;

a plurality of blades installed in the cartridge body along an elongated direction of the cartridge body, wherein each of the blades has a bent front portion;

a plurality of pairs of side fixation slots, each pair of side fixation slots formed on left and right frame portions of the cartridge body, respectively, so as to fix left and right lateral ends of each corresponding blade;

a supporter provided at a center area between the left and right frame portions of the cartridge body and connecting upper and lower frame portions of the cartridge body;

a plurality of inside fixation slots each formed on the supporter provided at the center area so as to fix a rear portion of each corresponding blade; and a handle body coupled to the cartridge body, wherein each of the inside fixation slots has an inclined surface configured to support the bent front portion of each corresponding blade.

17. The shaver according to claim 16, wherein the rear portion of each blade is generally straight.

18. The shaver according to claim 17, wherein the bent front portion and the rear portion of each blade are integrally formed such that each blade is a unitary blade.

* * * * *